United States Patent [19]

Tusset et al.

[11] 4,389,254

[45] Jun. 21, 1983

[54] CONTINUOUS TREATMENT OF STEEL SHEET

[75] Inventors: Vittorino Tusset, Oupeye; Jules Hancart, Jupille; Philippe Paulus, Liege, all of Belgium

[73] Assignee: Centre de Recherches Metallurgiques-Centrum Voor Research in de Metallurgie, Brussels, Belgium

[21] Appl. No.: 258,480

[22] Filed: Apr. 28, 1981

Related U.S. Application Data

[63] Continuation of Ser. No. 87,639, Oct. 23, 1979, abandoned.

[30] Foreign Application Priority Data

Oct. 27, 1978 [BE] Belgium ..... 871631

[51] Int. Cl.[3] ..... C23G 1/08

[52] U.S. Cl. ..... 134/3; 134/10; 134/13; 134/15; 134/27; 134/28; 134/41; 210/759

[58] Field of Search ..... 134/3, 41, 10, 28, 27, 134/15, 13; 210/758, 759

[56] References Cited

U.S. PATENT DOCUMENTS

| | | | |
|---|---|---|---|
| 1,269,443 | 6/1918 | Hoffman | 134/13 |
| 3,011,907 | 12/1961 | Davis | 134/41 |
| 3,025,189 | 3/1962 | Arden | 134/3 |
| 3,310,435 | 3/1967 | Robinson, Jr. et al. | 134/3 |
| 3,330,769 | 7/1967 | Golben | 134/41 |
| 3,630,933 | 12/1971 | Dudlik et al. | 134/3 |
| 3,796,628 | 3/1974 | Sen | 210/63 R |
| 3,819,516 | 6/1974 | Murchison et al. | 210/63 |
| 3,905,907 | 9/1975 | Shiga | 134/3 |

*Primary Examiner*—William F. Smith
*Attorney, Agent, or Firm*—Holman & Stern

[57] ABSTRACT

Steel sheet is subjected to a thermal treatment as a result of which an oxide layer is formed. The sheet is pickled by contact with an organic acid solution (formic acid), containing at least 50 mg/l of iron, at a pH of 1.5 to 4 and at a temperature above a minimum value $T_m$ given by $T_m = 20 + (pH - 1.5)32$.

10 Claims, 1 Drawing Figure

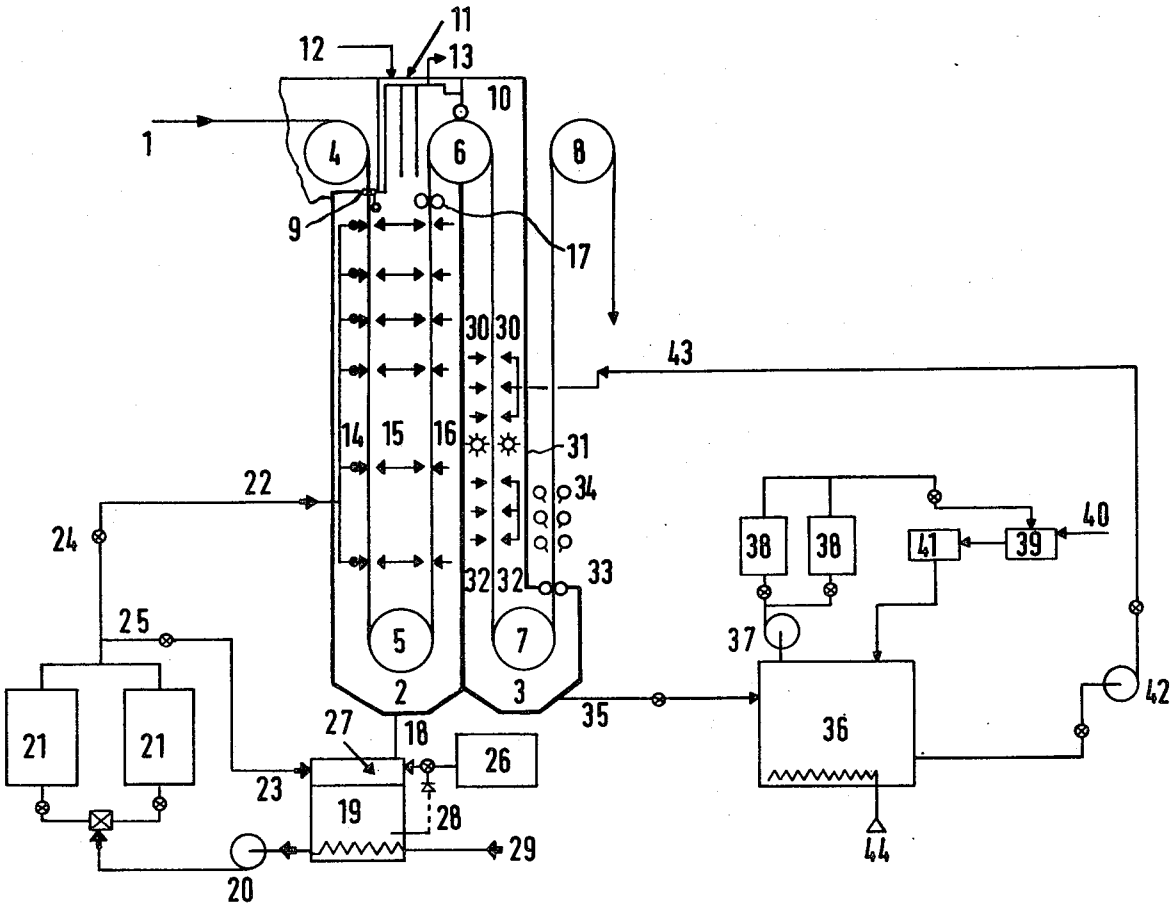
1
2
3
4
5
6
7
8
9
10
11
12
13
14
15
16
17
18
19
20
21
21
22
23
24
25
26
27
28
29
30
30
31
32
32
33
34
35
36
37
38
38
39
40
41
42
43
44

CONTINUOUS TREATMENT OF STEEL SHEET

This is a continuation of application Ser. No. 087,639, filed Oct. 23, 1979, now abandoned.

FIELD OF THE INVENTION

The present invention relates to a process for the continuous treatment of steel sheet, in which the sheet given a thermal treatment as a result of which an oxide layer is formed on the sheet. Such a thermal treatment may include heating with a naked flame and/or cooling with water.

DESCRIPTION OF THE PRIOR ART

Pickling of steel sheet is a well-known process and is frequently carried out by chemical means, with the aid of an inorganic acid such as sulphuric acid or hydrochloric acid, for example. This operation is costly, and for this reason is normally carried out in closed circuit with the attendant drawback that it cannot be performed continuously for the following reasons. When the oxidized sheet comes into contact with an acid solution, ferrous ions are dissolved. The pickling solution thus becomes increasingly loaded with ferrous ions and its acid content becomes so depleted that, after a certain time, it is unable to perform its pickling function. It then becomes necessary to stop the operation to remedy this condition, which is generally done by bringing in a fresh batch of pickling liquor. Another disadvantage of effecting the pickling of steel sheets by means of inorganic acids is that the sheets thus treated quite often display marks, such as pitting, for example, which may affect their surface qualities.

After pickling, the sheet is generally rinsed in an auxiliary bath, in order to eliminate residual acid. This rinsing operation is also carried out in closed circuit, owing to which the water employed is progressively loaded with acid, the concentration of which must be limited in consequence if satisfactory rinsing conditions are to be maintained. The result is that this rinsing operation also suffers from the same drawbacks of not leading itself to continuous performance.

BRIEF SUMMARY OF THE INVENTION

It is an object of this invention to provide a process which makes it possible to remedy these drawbacks and to carry out pickling and subsequent rinsing of steel sheet in a continuous operation, in combination with a thermal treatment which may involve heating with a naked flame and/or cooling with water.

This invention is based on the following considerations relating to the use, for pickling of steel sheet, of an organic acid solution, for example of formic acid, acetic acid, or citric acid.

The pH of such a solution can be adjusted to a value such as to satisfy the following two requirements:

pH sufficiently low to provide for reaction kinetics making the duration of pickling relatively short, with the notable advantage of reducing the length of the pickling line, pH value high enough to enable hydrolysis of the organic salt to take place with formation of a precipitate.

With regard to the temperature, this can be so regulated as to adapt the reaction rate to the type of oxide to be removed.

Moreover, the use of an organic acid offers the advantage of not leaving any traces which may impair the surface quality of the treated sheets.

In the case of pickling with formic acid, the following reactions take place, for example in a layer consisting of pure FeO:

(1) Pickling $$\underset{\text{formic acid}}{2\,HCOOH} + FeO \longrightarrow \underset{\text{ferrous formiate}}{(HCOO)_2Fe} + H_2O$$

(2) Oxidation of ferrous formiate to ferric formiate $$2\,(HCOO)_2Fe + \tfrac{1}{2}O_2 + 2\,HCOOH \longrightarrow (HCOO)_3Fe + H_2O$$

(3) Hydrolysis of ferric formiate $$(HCOO)_3Fe + 3H_2O \longrightarrow 3\,HCOOH + \underset{\text{precipitate}}{Fe\,(OH)_3}$$

The above reactions show clearly that the formic acid contained in the pickling liquid when the liquor is withdrawn from the pickling vat for recycling is completely regenerated. The only possible loss of formic acid thus results solely from its mechanical entrainment by the sheet passing through the pickling bath. These reactions further show that in fact only oxygen drawn from ambient air is consumed, as well as water added in small quantities.

In the course of our experiments we have ascertained, quite unexpectedly, that much better pickling of the sheet is effected when the pickling solution contains a certain amount of iron.

With regard to the operation of rinsing a sheet pickled with organic acid, it is possible to use a reactant capable of neutralizing or preferably of destroying this acid so as to permit this operation to be carried out in a continuous manner. In the case of pickling with formic acid, the rinsing of the sheet can be performed with a solution containing hydrogen peroxide in the presence of a catalyst, in accordance with the following reaction:

$$(4) \qquad HCOOH + H_2O_2 \xrightarrow{\text{catalyst}} CO_2 + 2\,H_2O.$$

It is seen that the products of this reaction, $CO_2$ and $H_2O$, have the advantage of not interfering with the performance of the process.

Moreover, the fact that the rinsing can be carried out in a closed cycle obviates the ever-important problem of discharging a polluted solution into the environment.

Accordingly, the present invention provides a process for the continuous treatment of steel sheet in which the sheet is subjected to a heating phase and a cooling phase, an oxide layer being formed on the sheet during at least one of these phases, and in which the sheet is brought into contact with a solution of at least one organic acid, the pH of the solution being maintained between a minimum value of 1.5 and a maximum value of 4 (i.e. $1.5 \leqq pH \leqq 4$), and the temperature (T) of the solution being maintained above a minimum value $T_m$ given by the equation:

$$T_m = 20 + (pH - 1.5)32$$

in which pH is the value at which the pH of the pickling solution is maintained (i.e. $T \geqq T_m$), the solution containing iron in an amount of at least 50 mg/l, preferably at least 100 mg/l.

The or each organic acid preferably has the following characteristics:

(a) it has no halogen atom; and (b) it has a pK value of less than 5 ($pK = -\log K$, where K is the acidity constant).

The pH value must be at least 1.5 in order to obtain a filterable precipitate of iron hydroxide, and at most 4 in order to ensure that the pickling rate is not too slow, that is to say, faster than 5 $mg/m^2 \cdot s$ (loss of weight).

In the case where the organic acid is formic acid, the pH of the pickling solution is preferably maintained at a value comprised between 2.6 and 3.6, and the temperature of this solution is preferably maintained at a value greater than 40° C.

In the case of hot-rolled sheets, which are usually covered with a thick oxide layer, it can be advantageous to effect the pickling in several successive enclosures (e.g. vats) by means of separate solutions, of which at least one will have a pH comprised between 1.5 and 4, an iron content of at least 50 mg/l, and a temperature higher than 40° C. The solution is preferably transferred from enclosure to enclosure in the same sense as the sheet in such a manner that in the last enclosure the solution has the above-specified characteristics.

The pickling solution is preferably recycled whilst promoting the decomposition of the iron salt into hydroxide and its precipitation in the form of $Fe(OH)_3$, subsequently eliminating this precipitate in a known operation such as settling or evaporation or, preferably, by filtration or centrifuging.

In a preferred embodiment an oxidising agent (preferably hydrogen peroxide, $H_2O_2$) is added to the organic acid solution, and the concentration of the oxidizing agent in the solution is maintained between a lower limit equal to the value necessary to ensure that at least 80% of the ferrous ions in the solution are oxidized to ferric ions and an upper limit which is at most 10 times, preferably 2 times, the lower limit.

Preferably, precipitation is facilitated either by adding a coagulant-flocculant, preferably organic, or by electro-coagulation.

The pickling solution may advantageously contain a foaming agent and/or a corrosion inhibitor.

The oxide layer covering the surface of the steel sheet can be caused, at least partly, by heating of the steel sheet in direct-fired furnace and/or by water cooling, e.g. immersion in water bath, which is preferably at a temperature of at least 75° C.

The sheet is advantageously subjected to a preheating before coming into contact with the pickling solution.

It has also been found advantageous to employ the pickling solution as a coolant medium, for example as a quenching bath.

With respect to the operation of purifying the pickling solution, it may be noted that the marked preference accorded to filtration or centrifuging is justified wherever settling is considered as a slow operation, requiring the handling of large volumes and where evaporation is considered as a process leading to the production of difficultly removable sediments. The choice between filtration and centrifuging will be decided by various factors, such as capital costs, maintenance costs, and space availability. It is to be noted that the flow volume of the pickling solution to be purified for recycling purposes depends on the conditions in which the thermal treatment has been carried out, on the kinetics of pickling, and on the admissible concentration of iron precipitate in the solution.

Rinsing of the sheet after pickling may be carried out with continuous recycling of rinsing water by subjecting the water to a process for neutralizing or chemically destroying the residual acid. In particular, formic acid contained in the wash liquor may be neutralized chemically by adding to this liquor a reactant such as hydrazine hydrate with formation of a soluble compound. The reaction with hydrazine is instantaneous and the addition of small quantities of this reactant rapidly increases the pH value of the liquor. This feature could be advantageous in the case where it is desired to reduce quickly the concentration of free organic acid without introducing an inorganic compound into the system.

Alternatively, formic acid contained in the wash liquor may be destroyed chemically by adding to this liquor hydrogen peroxide and a catalyst, for example copper or iron. As already stated above, this last feature offers the advantage whereby the two compounds produced by the reaction, namely $CO_2$ and $H_2O$, do not impede the execution of the process. However, since hydrogen peroxide is a powerful oxidizing agent, which, under certain conditions, could oxidize the sheet, it is expedient to eliminate excess hydrogen peroxide before recycling the treated liquor. With this end in view, the natural decomposition of hydrogen peroxide is preferably accelerated by agitation in the presence of metallic catalysts. To achieve this purpose, there may be associated with the reactor effecting the elimination of oxidation with hydrogen peroxide an auxiliary reactor, which permits one to increase the yield of the oxidation reaction, to eliminate the excess hydrogen peroxide, and to obtain a greater operational freedom (possibility of shutting down one of the reactors).

A small amount of hydrogen peroxide is advantageously left in the recycled water, with a view to destroying directly the organic acid on the sheet without oxidizing the sheet.

The advantage of the steel sheet treated by the above-described process is that it possesses (a) good corrosion-resistance, without it being necessary to protect the sheet by a film of oil, and (b) suitability for phosphating and painting after forming.

DETAILED DESCRIPTION

The following comparative examples are given to ensure a good understanding of the details of a pickling operation according to the present invention (parameters in accordance with the invention are indicated by an asterisk).

EXAMPLE 1 choice of acid

Steel sheet was heated in a direct-fired furnace (slightly oxidising naked flames) to 550° C., then under an $N_2/H_2$ atmosphere (5% $H_2$) to 750° C., and maintained at 750° C. for 1 min. It was then quenched to 60° C. by water jets. Subsequently it was reheated to 280° C. under the same protective gas, held at this temperature for 1 min, cooled in the atmosphere to 120° C., and finally wateer-quenched.

Thickness of oxide: 70 nanometers (nm).

Pickling. Conditions: controlled to provide a pickling time of 10 to 15 s; simple rinsing with water.

| Acid | pH | °C. | Fe content | Remarks |
|---|---|---|---|---|
| Hydrochloric | 3 | 60 | 100 mg/l | Yellow traces after rinsing |
| Sulphuric | 3 | 60 | 100 mg/l | Pitting corrosion during stocking |
| Nitric | 3 | 60 | 100 mg/l | Immediate reoxidation |

None of the mineral acids gave an acceptable surface. Organic acids: pickling bath at 85° C.

| Acid | pK (at 20° C.) | pH | Fe Content | Remarks |
|---|---|---|---|---|
| *Formic | 3.75 | 2.65 | 250 mg/l | Sheet perfectly white No corrosion during stacking. |
| *Acetic | 4.75 | 2.4 | 250 mg/l | |
| *Oxalic | 1.23 | 2.9 | 250 mg/l | |
| *Citric | 3.14 | 2.7 | 250 mg/l | |
| Methyl-amino-benzoic | 5.1 | 2.6 | 250 mg/l | Insufficient pickling |
| Tri-chloro-acetic | 2.85 | 2.8 | 250 mg/l | Pitting corrosion during stocking. |

Conclusions: The sheets pickled in the conventional way with mineral acids were very difficult to rinse and exhibited surface defects after stocking. The same was true with organic acids having a halogen radical. In contrast, the sheets pickled with the other organic acids did not exhibit subsequent attack, but the pK value of these acids was less than 5 so that the pickling time remained moderate. Among the organic acids satisfying these conditions, acetic acid and formic acid are the most available and cheapest. Formic acid has the additional advantage that it forms with water an azeotropic mixture at 107.1° C., which means that a formic acid solution more dilute than the azeotropic mixture, when boiling, gives a vapour phase which is richer in water than in acid.

The following examples utilise formic acid exclusively, but can be extended to other organic acids in accordance with the invention.

EXAMPLE 2 effect of pH

Steel sheet was heated to 900° C. under a protective atmosphere ($N_2$+5% $H_2$) and rapidly cooled by immersion in a bath of boiling water.

Thickness of oxide layer: 80 nm.

Pickling rate, V, in a solution of formic acid, having an iron content of about 250 mg/l, maintained at a temperature of 100° C.:

| V, mg/m$^2$.s | pH |
|---|---|
| 4 | 4.2 |
| 6 | 4* |
| 21.5 | 3.5* |
| 40 | 2.9* |
| 44 | 2.7* |
| 57 | 2.4* |
| 98 | 1.85* |

EXAMPLE 3 effect of iron content

Steel sheet was heated to 700° C. under a protective atmosphere ($N_2$+5% $H_2$) and rapidly cooled by immersion in a bath of boiling water.

Thickness of oxide coating: 30 nm.

Pickling in formic acid solution of pH 3.5 at 100° C.:

| Fe content of bath, mg/l | Reflectivity of pickled surface as % of that of the initial sheet |
|---|---|
| 10 | 40 |
| 20 | 60 |
| 40 | 80 |
| *60 | 100 |
| *150 | 120 |
| *250 | 140 |
| *400 | 150 |
| *500 | 150 |

It is to be noted that, in an unexpected manner, a minimum iron content is required if the sheet obtained is to be at least as bright as the initial sheet.

EXAMPLE 4 effect of temperature

Steel sheet was heated to 850° C. under a protective atmosphere ($N_2$+5% $H_2$) and rapidly cooled by immersion in a bath of boiling water.

Thickness of oxide layer: 60 nm.

Iron content of pickling solution maintained at about 100 mg/l.

| °C. | pH | V, mg/m$^2$.s | $T_m$ |
|---|---|---|---|
| 15 | 1.85 | 4 | 31.2 |
| *41 | 1.85 | 6 | 31.2 |
| 43 | 2.5 | 4.5 | 52 |
| *60 | 2.5 | 10 | 52 |
| 75 | 3.5 | 3 | 84 |
| *90 | 3.5 | 15 | 84 |

$T_m = 20 + (pH - 1.5)32$

It is to be noted that the minimum pickling rate (V) of 5 mg/m$^2$·s is only attained if the temperature is above both 40° C. and $T_m$.

EXAMPLE 5

Hot-rolled steel sheet (air cooled).

Thickness of oxide layer: 10 micrometers.

Pickling in a formic acid solution of pH 1.86 at 100° C.

Iron content of solution: 400 mg/l.

Pickling rate: 100 mg/m$^2$·s.

EXAMPLE 6

Cold-rolled steel sheet: thickness: 0.8 mm.

Continuous annealing by heating with naked flame to 500° C. in 15 s, and thereafter by radiant tubes under protective atmosphere ($N_2$+5% $H_2$) to 710° C. in 40 s.

Holding for 40 s at 710° C. under same atmosphere.

Rapid cooling by immersion in an aqueous bath at 95° C., until a sheet temperature of 150° C. is reached.

Reheating at 450° C. in 15 s, under the same atmosphere.

Holding at 450° C. for 35 s, under the same atmosphere.

Cooling to 300° C. in 20 s, under the same atmosphere.

Immersion in a formic acid solution (500 mg/l) at 98° C. for 15 s; pH 2.9; iron content: 250 mg/l.

Rinsing and brushing.

The sheet was bright at the end of the treatment.

EXAMPLE 7

Steel sheet, cold-rolled, thickness: 0.8 mm.

Continuous annealing by heating with slightly oxidising naked flames to 600° C. and then under protective atmosphere ($N_2$+5% $H_2$) to 710° C. in 30 s.

Holding at 710° C. for 40 s under $H_2/N_2$ (5% $H_2$).

Rapid cooling by jets of atmospheric gas until the sheet was at 450° C.

Holding at 450° C. for 180 s under $H_2/N_2$.

Cooling to 300° C. in 20 s under $H_2/N_2$.

Immersion in a formic acid solution (500 mg/l) at 98° C. for 20 s; pH 2.9; iron content: 400 mg/l.

Rinsing and brushing.

The sheet was bright at the end of the treatment and exhibited no pitting corrosion after two months of stocking.

EXAMPLE 8

Cold-rolled steel sheet; thickness: 0.8 mm.

Heating under protective atmosphere ($N_2$+5% $H_2$) to 710° C.

Holding at 710° C. for 40 s.

Cooling to 80° C. by water jets.

Pickling for 5 s in a formic acid solution of pH3, at 80° C., with an iron content of 300 mg/l.

Rinsing and brushing, followed by drying.

Reheating to 450° C. under $H_2/N_2$, and holding this temperature for 1 min.

Air jet cooling to 200° C.

Cooling to 40° C. by immersion in water.

The sheet was bright at the end of the treatment and exhibited no pitting corrosion after two months of stocking.

EXAMPLE 9 heat treatment plus combined cooling and pickling (a) Heat treatment data:

| Heating by naked flames in a furnace | |
|---|---|
| Sheet advance: | 0.1 m/s |
| Width of sheet: | 0.15 m |
| Sheet temperature: | 800° C. (at beginning of cooling) |
| Sheet thickness: | 1.24 mm. |

(b) Cooling and pickling data:

Bath temperature: 98° C.

Working capacity of bath: 1,500 l.

Sheet travel in bath: 4.40 m.

pH of bath: 2.9.

formic acid: 500 mg/l.

Iron content: 600 mg/l, stabilised by filtration and addition of $H_2O_2$ at the rate of 200 mg/l.

Taking into account the conditions of thermal treatment and of pickling, the bath can be kept stable in pH and in iron content by means of filtration at a rate of 2 liters per second, with filters of 3 micrometer mesh.

The accompanying drawing, given by way of example, illustrates a form of embodiment of a continuous pickling plant suitable for use in the process of the present invention.

The oxidised sheet 1 to be treated passes through a pickling vat 2 and a rinsing vat 3, following a trajectory defined by guiding pulleys 4, 5, 6, 7, and leaves the vat 3 in the cleaned state, passing over a final guiding pulley 8.

On entering the pickling vat 22, the sheet passes between sealing rollers 9 and on leaving the vat between sealing rollers 10. The upper wall 11 of the vat 2 is a double wall with condenser fins. This double wall serves for circulating cooling water, which enters in the direction indicated by the arrow 12 and leaves in the direction indicated by the arrow 13. Pickling with a formic acid solution is performed by means of a series of jets 14, 15, 16 and, prior to leaving the vat 2, the sheet passes between drying rollers 17.

Pickling solution to be recycled is drawn from vat 2 along a pipe 18, passes into a tank 19, and is conveyed from there by a pump 20 into a double filter unit 21, from the outlet of which it is returned either to the vat 2 in the direction of arrow 22, or into the tank 19 in the direction of arrow 23, with the aid of valves 24 and 25.

The tank 19 is fitted with an acid holder 26, a water admission device 27 optionally for recycle wash water, a pH meter 28, and a preheating system 29 to maintain optimum recycling conditions.

After leaving the pickling vat 2 by passing between the sealing rollers 10, the pickled sheet enters the rinsing vat 3, where it passes successively between two series of jets 30, between two brushes 31, and again between two series of jets 32. The sheet thus washed emerges from the vat 3, passing between two drying rollers 33 and into an air-drying unit 34, before reaching the last guide pulley 8.

The wash liquor to be recycled is drawn from the vat 3 along a pipe 35 and passes into a tank 36; and a portion of this water is conveyed by a pump 37 to a double filter unit 38, then into a unit for eliminating formic acid by means of hydrogen peroxide introduced at 40 and into an auxiliary vat 41 for eliminating excess hydrogen peroxide, and finally into a tank 36. The purified wash water is conveyed by a pump 42 from the tank 36 to the vat 3 in the direction indicated by arrow 43. The tank 36 is provided with a preheating system 44 to maintain optimum recycling conditions.

In the plant described above the sheet is contacted with the pickling solution by means of jets, but this contact could alternatively be realized by immersion in an appropriate bath.

We claim:

1. A process for the continuous treatment of steel sheet, comprising the sequential steps of:

thermally treating the steel sheet to form an oxide layer on its surface;

pickling the sheet having the oxide layer by bringing the sheet into contact with a solution of formic acid, the solution having an iron content of at least 50 mg/l, while maintaining the pH of the solution between 1.5 and 4, and maintaining the temperature of the solution both above 40° C. and above a minimum value $T_m$ in C.° given by the equation $$T_m = 20 + (\text{pH of solution} - 1.5)32;$$

and adding hydrogen peroxide oxidizing agent to the solution, while maintaining the concentration of the oxidizing agent in the solution between a minimum value equal to the value necessary to oxidize at least 80% of the ferrous ions in solution to ferric ions and a maximum value of up to ten times the minimum value wherein, the formic acid pickling solution is self-regenerating by the sequential steps of, reacting the formic acid with the ferrous oxide coating of the sheet to yield ferrous formiate and water, reacting the ferrous formiate, the hydrogen peroxide oxidizing agent which is added, and the formic acid together to form ferric formiate and water, and producing a hydrolysis reaction between the ferric formiate and the water to regenerate the formic acid and produce a ferric hydroxide precipitate;

removing the ferric hydroxide precipitate from the pickling solution, and recycling the regenerated formic acid.

2. A process as claimed in claim 1, in which the rate of weight loss of the sheet during pickling is at least 5 $mg/m^2 \cdot s$.

3. A process as claimed in claim 1, in which the iron content of the organic acid solution is at least 100 mg/l.

4. A process as claimed in claim 1, in which the formic acid solution has a pH of 2.6 to 3.6.

5. A process as claimed in claim 1, in which pickling is carried out in several successive enclosures by means of separate solutions, of which at least one is the said formic acid solution and has a temperature higher than 40° C.

6. A process as claimed in claim 1, in which the maximum concentration value of the oxidizing agent is twice the minimum.

7. A process as claimed in claim 1, including rinsing the pickled sheet with water, and continuously recycling the rinse water while subjecting it to a treatment for neutralizing or chemically destroying residual acid.

8. A process as claimed in claim 7, in which the formic acid contained in the rinse solution is chemically destroyed by adding to this solution hydrogen peroxide and a catalyst.

9. A process as claimed in claim 8, wherein the catalyst is copper or iron.

10. A process as claimed in claim 1, wherein the iron content is from 60 to 500 mg/l.

* * * * *